US006012968A

United States Patent [19]

Lofaro

[11] Patent Number: 6,012,968

[45] Date of Patent: Jan. 11, 2000

[54] APPARATUS FOR AND METHOD OF CONDITIONING CHEMICAL MECHANICAL POLISHING PAD DURING WORKPIECE POLISHING CYCLE

[75] Inventor: Michael F. Lofaro, Marlboro, N.Y.

[73] Assignee: International Business Machines Corporation, Armonk, N.Y.

[21] Appl. No.: 09/127,344

[22] Filed: Jul. 31, 1998

[51] Int. Cl.[7] ..... B24B 53/00

[52] U.S. Cl. ..... 451/39; 451/40; 451/56; 451/72; 451/444

[58] Field of Search ..... 451/39, 40, 53, 451/54, 75, 80, 65, 72, 443, 444

[56] References Cited

U.S. PATENT DOCUMENTS 5,036,630 8/1991 Kaanta et al. .

5,341,608 8/1994 Mains, Jr. ..... 451/39

5,547,417 8/1996 Breivogel et al. ..... 451/443 X 5,664,987 9/1997 Rentein ..... 451/443 X 5,716,264 2/1998 Kimura et al. ..... 451/443

5,725,417 3/1998 Robinson ..... 451/56

5,782,675 7/1998 Southwick ..... 451/444 X

*Primary Examiner*—David A. Scherbel

*Assistant Examiner*—Anthony Ojini

*Attorney, Agent, or Firm*—Scully, Scott, Murphy & Presser; Alison Mortinger

[57] ABSTRACT

A method and apparatus for conditioning a polishing pad. In this method and apparatus a glazed polishing pad is conditioned by being contacted with a stream of cryogenic pellets.

19 Claims, 1 Drawing Sheet

APPARATUS FOR AND METHOD OF CONDITIONING CHEMICAL MECHANICAL POLISHING PAD DURING WORKPIECE POLISHING CYCLE

BACKGROUND OF THE INVENTION

1. Field of the Invention

The present invention is directed to an apparatus for and a method of conditioning glazed polishing pads. More specifically, the present invention focuses upon an apparatus for and a method of conditioning chemical mechanical polishing pads during the polishing of workpiece surfaces.

2. Background of the Prior Art

A critical step in the formation of workpieces, for example, semiconductor wafers, is the polishing of their surfaces prior to processing. There are major, related problems associated with this operation. A first problem is the requirement of replacing the polishing pad after about 500 cycles, thus adding expense and slowing the continuous nature of this operation. A second, related problem is obtaining optimum planarization during the chemical mechanical polishing process.

The above problems are associated with the basic aim of chemical mechanical polishing, a clean uniform surface. This result, in turn, is a function of the uniformity of the polishing pad. A polishing pad must itself be uniform to insure that the polished surface of the workpiece is similarly uniform.

It has been found that hard polyurethane pads provide the best uniformity when the workpiece is a semiconductor wafer. However, as those skilled in the art are aware, a polyurethane pad is characterized by an open pore structure. As such, the pad requires a regimented conditioning cycle to remove debris that accumulates on its surface and in its pores. Thus, a system has developed wherein a workpiece, e.g. a semiconductor wafer, or a plurality of workpieces are polished by the polishing pad followed by a step of removing the debris, denoted in the art as glazing, from the polishing pad surface. Glazing is a collective term for polished off workpiece residual, polishing slurry and pad material that presses into pores of the polishing pad. Glazing of the polishing pad surface has adverse consequences which include reduced workpiece surface removal rates, reduction of thickness uniformity across the workpiece and a general increase in workpiece surface defects. These surface defects include scratches, divots and the like.

To reduce polishing pad degradation, the prior art has developed pad conditioning methods. In general, these methods involve abrading the surface of the pad material by means of a mechanical apparatus which rotates a diamond impregnated disk on the pad surface. Although this method has increased useful pad life by reducing glazing degradation, it suffers from several defects. The most obvious of these defects is the systemic destruction of the pad over time. This drawback is obvious insofar as the surface of the pad is continually diminished by this abrading step. At present, the best polishing pads, e.g. the lowest abrading polyurethane pads, yields no more than about 500 workpiece cycles per pad.

Not only does the polishing pad conditioning system of the prior art have the drawback of requiring replacement of the polishing pad after approximately 500 cycles but, in addition, because the diamond impregnated disk wears over time, so does the uniformity of the polishing pad resulting in non-uniform polished workpiece surface over the approximately 500 cycle useful life duration of the polishing pad.

In view of the revolutionary change in pad conditioning accomplished the present invention, it is not necessary to discuss prior art references which utilize systems typical of the art described above. Those systems, methods and apparatus are so far removed from the present invention as to be totally irrelevant thereto. However, the present invention utilizes a system developed by the Cryogenesis® Company. The Cryogenesis® system utilizes a pelletizer which converts liquid carbon dioxide into high density dry ice pellets. The pellet length, diameter, density and the rate at which the pellets are generated is computer controlled. The Cryogenesis® pelletizer is provided with a gun which delivers the dry ice particles at high velocity to a surface. All this is described Cryogenesis® literature and is known in the art.

U.S. Pat. No. 5,036,630 sets forth a method of polishing a semiconductor wafer utilizing wafer polishing apparatus of the type utilized in the present invention. However, the method employed in conditioning the polishing pad is typical of processes utilized in the prior art whose disabilities are discussed above.

The above remarks establish the need in the art for a new method of chemical/mechanical polishing (CMP) process which provides a more efficient and longer lasting method of pad conditioning.

BRIEF SUMMARY OF THE INVENTION

A new process has now been developed to permit surface polishing of a workpiece, such as a semiconductor wafer, which not only improves the quality of the polishing step but permits this process to occur continuously over many more cycles than those utilized in the prior art.

In accordance with the present invention a process of conditioning a glazed polishing pad is provided. In this process a glazed polishing pad is conditioned by contacting the polishing pad with a stream of cryogenic particles whereby the glaze on the surface of the polishing pad is removed.

In further accordance with the present invention an apparatus for conditioning the surface of a glazed polishing pad is disclosed. This apparatus includes means for contacting a polishing assembly provided with a glazed polishing pad with a stream of cryogenic particles whereby the glaze on the surface of the polishing pad is removed.

DETAILED DESCRIPTION

The present invention is directed to an improved apparatus and process for conditioning a glazed polishing pad. The improved process and apparatus of the present application utilizes a novel method of conditioning the polishing pad wherein the surface of the polishing pad is not abraded. The resultant non-abraded polishing pad is thus more efficiently utilized in the uniform polishing of workpiece surfaces. Because of the non-destructive nature of the conditioning of the polishing pad, the polishing pad retains its original surface characteristics and thickness over longer polishing cycles without interruption resulting in a far longer useful period of operation than similar polishing pads subject to the conditioning methods of the prior art.

Figure 1:
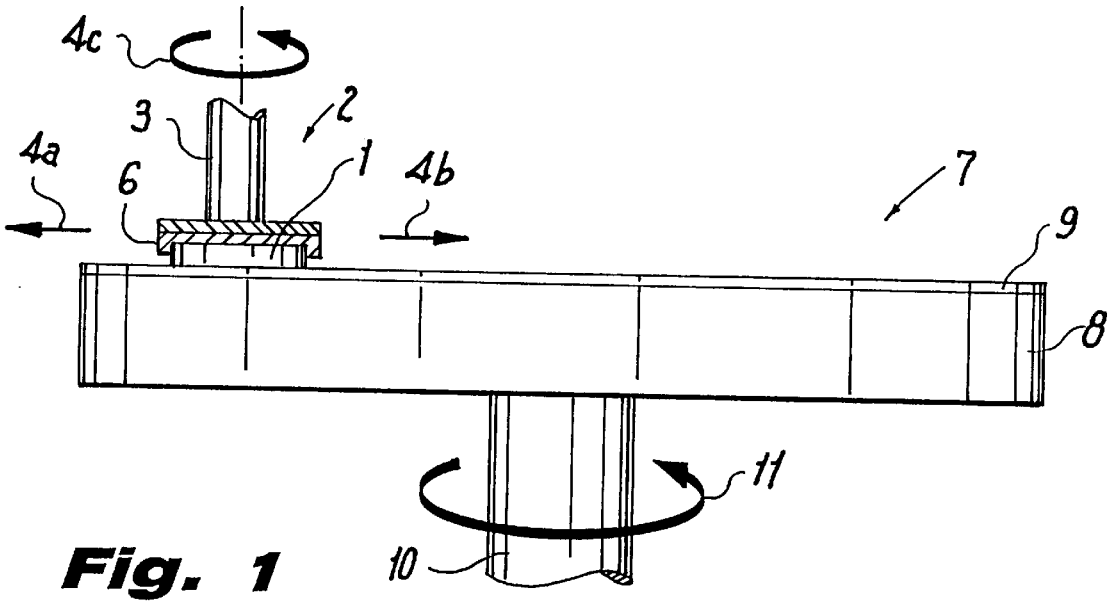
FIG. 1 is a schematic illustration, partially in cross-section, of an apparatus polishing a workpiece in accordance with the present invention.

The present process and apparatus can be better understood by reference to the accompanying drawings of which FIG. 1 schematically illustrates the polishing of the surface of workpiece surface disposed in a workpiece carrier. The carrier, generally indicated at 2, is depicted with a workpiece 1, preferably a semiconductor wafer, held thereto. The workpiece 1 is held by an edge portion 6 of the carrier 2 which prevents the workpiece 1 from sliding out from under the carrier 2 during carrier movement. The carrier 2 includes a spindle 3 which is coupled to any suitable motor or driving means (not shown) for moving the carrier 2 in the directions 4*a*, 4*b* and 4*c* as set forth in FIG. 1. The spindle 3 may support a load (not shown) exerted against the carrier 2 and thus against the workpiece 1 during polishing.

In the polishing operation, a movable polishing assembly, generally indicated at 7, rotates, as indicated by arrow 11. That is, the assembly 7, which includes a polishing table 8, is rotatable, as illustrated by arrow 11, around shaft 10.

The polishing assembly 7 includes a polishing pad 9 positioned on a table 8. In a preferred embodiment the polishing pad 9 is constructed of polyurethane. Polyurethane, especially hard polyurethane, is generally accepted as the preferred material of construction in the polishing of certain workpieces such as semiconductor wafers. Polyurethane, employed as a polishing pad, is characterized by an open pore structure which permits glazing of its surface due to polish residuals, polishing slurries and pad material being pressed into the pores present in the polyurethane structure.

In operation, the workpiece 1, which, in a preferred embodiment, as suggested above, is a semiconductor wafer, is contacted by polishing pad 9 to smooth and polish the surface of the workpiece. As depicted in FIG. 1, both polishing assembly 7 and workpiece carrier 2 rotate. The movement of the carrier, of course, dictates movement of the workpiece. Workpiece 1 movement, as illustrated by directions 4*a*, 4*b* and 4*c*, can be provided over the entire surface of the polishing pad 9.

Upon completion of the workpiece polishing step some of the material polished of the surface of the workpiece 1, a portion of the polishing slurry employed in polishing the workpiece and pad material abraded by the workpiece becomes embedded in pores (not shown) on the polishing pad 9. The aforementioned constituents which become embedded in the pores on pad 9 are collectively referred to as glazing.

Figure 2:
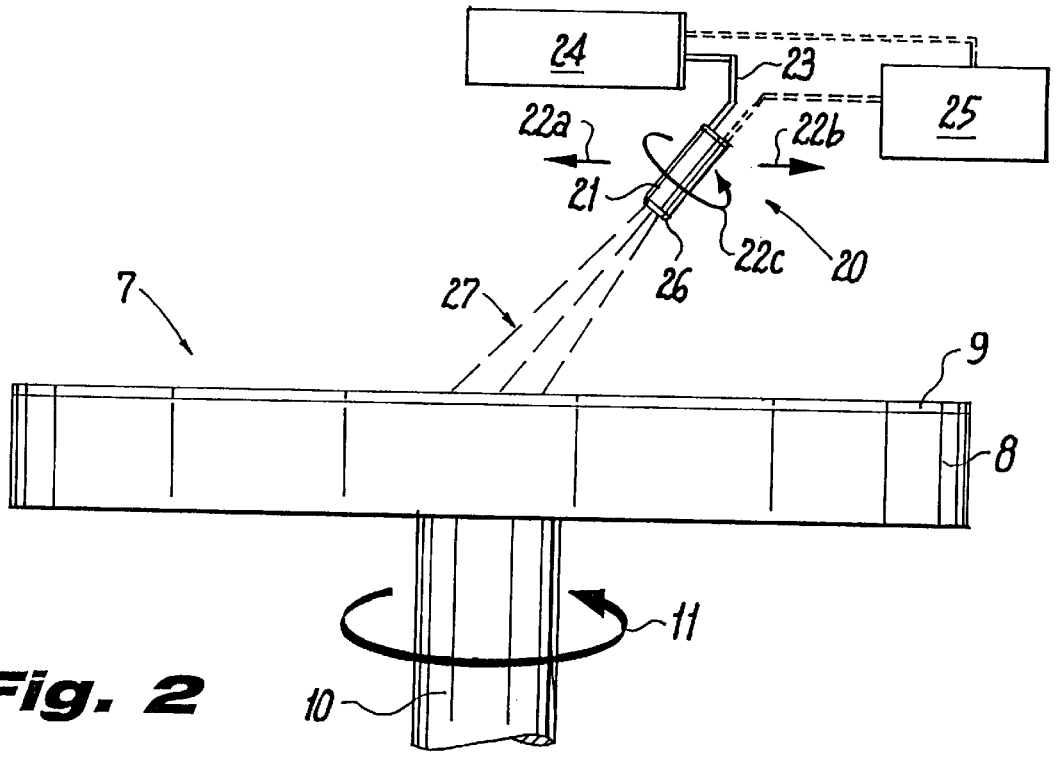
FIG. 2 is a schematic illustration of the polishing apparatus of FIG. 1 being conditioned in accordance with the present invention.

The apparatus and process of the present invention includes means for and the step of conditioning the polishing pad 9 by removing glazing from its surface. This is accomplished by contacting the pad 9 surface with a stream of cryogenic particles. This is illustrated in FIG. 2 wherein the polishing assembly 7 is depicted adjacent a polishing pad conditioning means generally indicated at 20. The polishing pad conditioning means 20 includes a cryogenic spraying gun 21 provided with a spray nozzle 26 for emitting cryogenic particles. The gun 21 is movable in all directions, as indicated by arrows 22*a*, 22*b* and 22*c* over the surface of the pad. The gun 21 is in communication with a cryogenic fluid source 24 by means of conduit 23. The operation may be computer controlled by computer means 25.

The polishing pad conditioning means 20 delivers cryogenic pellets 27 emitted through the nozzle 26 provided on the cryogenic spraying gun 21 to the surface of the polishing pad 9. The cryogenic pellets are delivered under high pressure and high velocity. The velocity of the pellets may indeed exceed supersonic speed. Under these conditions glazing, embedded in the pad 9, is removed. This desirable removal of glazing occurs with no concurrent abrasion of the polishing pad 9, resulting in no loss of material from the surface of the polishing pad 9. This operation, furthermore, produces no polishing pad surface defects.

In a preferred embodiment the cryogenic pellets 27 are dry ice particles. In this preferred embodiment the cryogenic fluid source 24 is liquid carbon dioxide. In this embodiment the dry ice particles impact the surface of the pad 9 by means of high velocity air which entrains the particles 27 in a two-phase solid-gaseous steam.

Although the present invention is not dependent upon any theory explaining its operability, it is theorized that favorable polishing pad conditioning results are obtained because of the novel physical effects which result from the impacting of the cryogenic pellet-gas stream on the surface of the polishing pad. The cryogenic pellets, which in a preferred embodiment are dry ice particles, entrained by the high velocity gaseous stream, which in a preferred embodiment is air, breaks the physical bond holding the glazing to the pores of the polishing pad. Furthermore, this stream shakes loose this glazing and lifts it away to provide a cleaned polishing pad surface without the requirement of abrading away any of the polishing pad material. This operation prolongs the polishing pad useful life and also provides a uniform polishing pad surface. In turn, this results in a consistent polishing effect from one workpiece to the next.

Specifically, it is theorized that the cryogenic pellet-gaseous two-phase high energy stream, which impacts the polishing pad surface at very cold temperatures, causes the breakup of the physical bond between the glazing and the polishing pad surface due to differences in the thermal coefficient of expansion and contraction of the glazing on the one hand and material of construction of the polishing pad, e.g. polyurethane, on the other. The glazing material, unbonded from the polishing pad, is thereupon loosened due to the high level of kinetic energy imparted by the high pressure, high velocity gaseous stream. Finally, thermal expansion of the heated gas in the two-phase stream, upon contact with the relatively hot polishing pad surface, effects a lifting away, from the polishing pad surface, of the glazing embedded in the pores of the pad and on the surface of the pad.

The glazing removal step in the apparatus and process of the present invention is conducted in a manner that provides a cryogenic pellet-gaseous two-phase stream which impacts the surface of the polishing pad at a preferred temperature in the range of between about −150° F. and −25° F. More preferably, the temperature of the two-phase stream is at a range between about −125° F. and about −50° F. Even more preferably, the temperature range of the two-phase stream is between about −100° F. and −65° F. Most preferably, the temperature of the two-phase stream is about −75° F.

The two-phase stream impacts the polishing pad at a pressure in the range of between about 75 lbs. per square inch (psi) to about 200 psi. Preferably, this pressure range is between about 80 psi and 150 psi. More preferably, the pressure of the two-phase stream is in the range of between about 85 psi and about 125 psi. Still more preferably, the pressure range of the two-phase stream is about 90 psi and about 100 psi.

The volumetric flow rate of the two-phase stream is in the range of between about 100 cubic feet per minute (cfm) to about 300 cfm. Preferably, the volumetric flow rate of the two-phase stream is about 125 cfm to about 200 cfm. Still more preferably, the volumetric flow rate is in the range of between about 135 cfm and about 175 cfm. Most preferably, the volumetric flow rate is approximately 150 cfm.

The mass rate of flow of the cryogenic, e.g. dry ice, pellets impacting the polishing pad surface is in a range of between about 25 lbs. per hour (lb/hr) and about 200 lb/hr. Preferably, this mass flow rate is in the range of between about 35 lb/hr and about 150 lb/hr. More preferably, the mass flow rate is from about 50 lb/hr to about 125 lb/hr. Most preferably, the mass flow rate ranges between about 75 lb/hr and about 100 lb/hr.

In a preferred embodiment of the conditioning process and apparatus of the present invention, the conditioning step, discussed above, occurs after each workpiece polishing operation. In this "in-situ" processing a workpiece, which is, in a particularly preferred embodiment, a semiconductor wafer, is polished with a polishing pad in accordance with description given above in the discussion of FIG. 1. Thereupon, the polishing pad is conditioned in accordance with the description of FIG. 2. In this manner a sequential operation of polishing and conditioning a plurality of workpieces and the polishing pad is conducted.

This "in-situ" conditioning is distinguished from consecutive polishing operations wherein a large number of workpieces are subjected to chemical-mechanical polishing before the polishing pad is subjected to conditioning in accordance with the present invention. It is emphasized that conditioning and polishing in accordance with a consecutive polishing operation is within the scope of the present invention.

While the invention has been particularly shown and described with respect to (a) preferred embodiment(s) thereof, it will be understood by those skilled in the art that the foregoing and other changes in form and details may be made therein without departing from the spirit and scope of the invention.

Having thus described my invention, what I claim as new, and desire to secure by Letters Patent is:

1. A method of conditioning a glazed polishing pad having a glaze therein comprising a step of contracting said glazed polishing pad with a stream of cryogenic particles whereby said glaze on said polishing pad is removed.

2. A method in accordance with claim 1 wherein said stream of cryogenic particles comprises a two-phase stream of dry ice and air.

3. A method in accordance with claim 2 wherein said two-phase stream is supplied to the surface of said polishing pad at a temperature in the range of between about −150° F. and about −25° F. in an amount of between about 25 lbs. per hour and about 200 lbs/hr, said dry ice two-phase stream supplied at a pressure of between about 75 psi and about 200 psi at a volumetric flow of between about 100 cfm and about 300 cfm.

4. A method in accordance with claim 3 wherein said two-phase stream is supplied at a temperature of between about −125° F. and about −50° F., a pressure of between about 80 psi and about 150 psi, a mass flow rate of between about 35 lbs/hr and about 150 lbs/hr, a pressure of between about 80 psi and about 150 psi and a flow rate of between about 125 cfm and about 200 cfm.

5. A method in accordance with claim 4 wherein said two-phase stream is supplied at a temperature in the range of between about −100° F. and about −65° F., a mass flow rate of between about 50 lbs/hr and about 125 lbs/hr, a pressure of between about 85 psi and about 125 psi and a volumetric flow rate of between about 135 cfm and about 175 cfm.

6. A method in accordance with claim 5 wherein said two-phase stream is supplied at a temperature approximately −75° F., said mass flow rate is between about 75 lbs/hr and about 100 lbs/hr, a pressure of between about 90 psi and about 100 psi and a volumetric flow rate of approximately 150 cfm.

7. A method of polishing a workpiece comprising contacting a workpiece on a carrier with a polishing pad whereby said workpiece is polished and said polishing pad is conditioned in accordance with the method of claim 1.

8. A method in accordance with claim 7 wherein said step of conditioning said glazed polishing pad occurs sequentially after each step of polishing a workpiece.

9. A method in accordance with claim 8 wherein said workpiece is a semiconductor wafer.

10. An apparatus for conditioning a glazed polishing pad having a glaze therein comprising means for contacting said glazed polishing pad with a stream of cryogenic particles whereby said glaze on said polishing pad is removed.

11. An apparatus in accordance with claim 10 wherein said stream of cryogenic particles comprises a two-phase stream of dry ice and air.

12. An apparatus in accordance with claim 11 wherein said two phase stream is characterized by a temperature in the range of between about −150° F. and about −25° F.; a mass flow rate of between about 25 lbs/hr and about 200 lbs/hr; a pressure of between about 75 psi and about 200 psi; and a volumetric flow rate of between about 100 cfm and about 300 cfm.

13. An apparatus in accordance with claim 12 wherein said two-phase stream is characterized by a temperature in the range of between about −125° F. and −50° F.; a mass flow rate in the range of between about 35 lbs/hr and about 150 lbs/hr; a pressure in the range of between about 80 psi and about 150 psi; and a volumetric flow rate in the range of between about 125 cfm and about 200 cfm.

14. An apparatus in accordance with claim 13 wherein said two-phase stream is characterized by a temperature in the range of between about −100° F. and about −65° F.; a mass flow rate in the range of between about 50 lbs/hr and about 125 lbs/hr; a pressure in the range of between about 85 psi and about 125 psi; and a volumetric flow rate in the range of between about 135 cfm and about 175 cfm.

15. An apparatus in accordance with claim 14 wherein said two-phase stream is characterized by a temperature of approximately −75° F.; a volumetric flow rate in the range of between about 75 lbs/hr and about 100 lbs/hr; a pressure in the range of between about 90 psi and about 100 psi; and a volumetric flow rate of approximately 150 cfm.

16. An apparatus for polishing a workpiece comprising a carrier provided with means for holding a workpiece; a polishing assembly provided with a polishing pad which contacts the workpiece disposed in said carrier wherein said workpiece is polished and wherein said polishing pad is glazed; and means for conditioning said polishing pad in accordance with the apparatus of claim 10.

17. An apparatus in accordance with claim 16 wherein said workpiece is a semiconductor wafer.

18. An apparatus in accordance with claim 10 wherein said means for contacting said glazed polishing pad with a stream of cryogenic particles includes a cryogenic spraying gun provided with a spray nozzle in communication with a cryogenic fluid source.

19. An apparatus in accordance with claim 18 wherein said stream of cryogenic particles is provided by dry ice and wherein said cryogenic fluid source is liquid carbon dioxide.

* * * * *